US008182286B2

(12) United States Patent
Tamagawa et al.

(10) Patent No.: US 8,182,286 B2
(45) Date of Patent: May 22, 2012

(54) WATER-PROOFING JOINT CONNECTOR

(75) Inventors: Tatsuo Tamagawa, Yokkaichi (JP); Hiroki Hirai, Yokkaichi (JP); Tetsuji Tanaka, Yokkaichi (JP); Takashi Tsuchiya, Yokkaichi (JP); Yasuo Omori, Yokkaichi (JP); Tomoyuki Sakata, Yokkaichi (JP)

(73) Assignees: Autonetworks Technologies, Ltd., Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 13/146,540

(22) PCT Filed: Jan. 21, 2010

(86) PCT No.: PCT/JP2010/050724
§ 371 (c)(1),
(2), (4) Date: Jul. 27, 2011

(87) PCT Pub. No.: WO2010/087272
PCT Pub. Date: Aug. 5, 2010

(65) Prior Publication Data

US 2011/0287647 A1 Nov. 24, 2011

(30) Foreign Application Priority Data

Jan. 29, 2009 (JP) ..... 2009-018444

(51) Int. Cl.
*H01R 13/40* (2006.01)

(52) U.S. Cl. ..... 439/587

(58) Field of Classification Search ..... 439/587, 439/148, 936, 588, 274, 275
See application file for complete search history.

(56) References Cited

U.S. PATENT DOCUMENTS

| | | | | |
|---|---|---|---|---|
| 5,201,667 | A | 4/1993 | Endo et al. | |
| 6,419,515 | B1 * | 7/2002 | Okayasu | 439/358 |
| 6,461,187 | B2 * | 10/2002 | Chen | 439/358 |
| 6,688,907 | B2 * | 2/2004 | Yamaoka et al. | 439/489 |
| 7,114,983 | B2 * | 10/2006 | Fukatsu et al. | 439/358 |
| 2005/0186842 | A1 | 8/2005 | Fukatsu et al. | |
| 2010/0203756 | A1 * | 8/2010 | Omori et al. | 439/507 |
| 2011/0287647 | A1 * | 11/2011 | Tamagawa et al. | 439/147 |

FOREIGN PATENT DOCUMENTS

| | | |
|---|---|---|
| JP | 4-27588 | 3/1992 |
| JP | 2005-243335 | 9/2005 |

* cited by examiner

*Primary Examiner* — Tulsidas C Patel
*Assistant Examiner* — Phuongchi Nguyen
(74) *Attorney, Agent, or Firm* — Greenblum & Bernstein P.L.C.

(57) ABSTRACT

The present invention provides a water-proofing joint connector capable of electrically interconnecting a plurality of terminals, with a simple structure, irrespective of the number of the terminals. The water-proofing joint connector includes a connection conductor, a housing and a cap member. The connecting conductor has a plurality of fitting portions to be fitted with respective terminals, preliminarily held within the housing. The housing includes a plurality of terminal insertion portions and a cap-member insertion portion which opens to an opposite side of the terminal insertion portions. The cap member has a cap portion to close the cap-member insertion portion and a fit detection portion to come into contact with the terminal locking portion elastically displaced by the terminals failing to be fully fitted, to thereby prevent the cap member from being attached to the cap-member insertion portion.

5 Claims, 7 Drawing Sheets

WATER-PROOFING JOINT CONNECTOR

BACKGROUND OF THE INVENTION

1. Field of the Invention

The present invention relates to a water-proofing joint connector for electrically interconnecting a plurality of water-proofing electric wires included in a vehicle wire harness or the like.

2. Description of the Related Art

Heretofore, there has been known a water-proofing joint connector for electrically interconnecting a plurality of water-proofing electric wires as described, for example, in JP-U 4-27588A. Such a type of water-proofing joint connector is shown in FIG. 9.

The water-proofing joint connector is designed to electrically interconnect a plurality of terminals 72 each attached to an electric wire 70, comprising a housing 80 and a rubber plug body 90.

The housing 80 includes a plurality of terminal insertion portions 82 each having an opening which opens in a specific direction to allow corresponding one of the terminals 72 to be inserted into the terminal insertion portion through the opening, a plurality of deflectable support portions 84 to lock the inserted terminals respectively, and a plug-body receiving chamber 86 having an opening which opens in a direction opposite to the terminal insertion portions 82 to allow the rubber plug body to be inserted into the plug-body receiving chamber 86 through the opening. The terminal insertion portions 82 has an inner peripheral surface, with which an outer peripheral surface of a water-proofing plug 74 attached to each of the electric wire 70 comes into tight contact.

The rubber plug body 90 is integrally provided with a short-circuiting metal member 96. The short-circuiting metal member 96 integrally has a plurality of contact portions 92 and a plurality of insertion detection bars 94. Each of the contact portions 92 is to be fitted with the terminals 72 each locked by the deflectable support portions 84 respectively, along with the insertion of the rubber plug body 90 into the plug-body receiving chamber 86, thereby electrically and mutually connecting the terminals 72. Each of the insertion detection bars 94 is to make contact with the deflectable support portions 84, upon the faulty insertion of any one of the terminals 72, to hinder the insertion of the rubber plug body 90 into the plug-body receiving chamber 86, thereby allowing the defective insertion to be detected.

The water-proofing joint connector shown in FIG. 9, however, involves a high resistance to the insertion of the rubber plug body 90 into the housing 80, which makes it difficult to determine whether the insertion of the terminals 72 is adequate or not and also to set a terminal locking force of the deflectable support portions 84.

Specifically, the rubber plug body 90, which is integrally provided with the short-circuiting metal member 96 for mutual short-circuiting of the terminals 72, is inserted into the housing 80, involving the simultaneous fit of the contact portions 92 of the short-circuiting metal member 96 with the respective terminals 72; thus, the resistance of the fit is directly added to the insertion resistance of the rubber plug body 90, and the greater number of the terminals 72 makes the fitting resistance larger. For this reason, even a normal state where all of the terminals 72 are adequately inserted involves a large resistance to the insertion of the rubber plug body 90, which makes it difficult to determine whether the large resistance is caused by the fitting resistance of the terminals 72 (i.e., is a resistance in the normal state) or by the contact of the insertion detection bar 94 with the deflectable support portions 84 as a terminal locking portion due to the faulty insertion of the terminal 72. The determination becomes more difficult as the fitting resistance becomes larger.

On the other hand, each of the deflectable support portions 84 of the housing 80, required to lock corresponding one of the terminals 72 against a reaction force for the fitting resistance, must have a locking force set to be a great value, thus inevitably involving an increase in size of the housing 80. On contrary, if the locking force is insufficient, the resistance to the fitting between the terminals 72 and the fitting portions 92 may cause the terminals 72 to be moved away from the deflectable support portions 84 in advance of the complete fitting of the fitting portion 92 with the terminal 72, deteriorating the insertion reliability of terminals 72.

SUMMARY OF THE INVENTION

In view of the above circumstances, the present invention has an object to provide a water-proofing joint connector for electrically interconnecting a plurality of water-proofing electric wires each including an end provided with a terminal and a water-proofing plug provided on a rear side of the terminal, which connector is capable of reliably establishing the electrical interconnection of the terminals, with a simple structure, irrespective of the number of the water-proofing electric wires or the terminals. This water-proofing joint connector comprises a connection conductor, a housing and a cap member. The connecting conductor integrally has a plurality of fitting portions each formed in a shape capable of fitting with corresponding one of the terminals, the fitting portions arranged in a direction perpendicular to a direction in a fitting direction of the fitting, and a joint portion interconnecting the fitting portions. The housing includes: a plurality of terminal insertion portions each having a first opening which opens in a specific direction to allow corresponding one of the terminals and the water-proofing plug on the rear side of the terminal to be inserted into the terminal insertion portion through the first opening and an inner peripheral surface with a shape tightly contactable with the water-proofing plug; a cap-member insertion portion having a second opening which opens in a direction opposite to the terminal insertion portions; a conductor holding portion directly holding the connecting conductor to allow each of the terminals inserted through the first opening of the terminal insertion portion to a normal fit position to be fitted with the fitting portion along an insertion direction of the insertion of the terminal; and a plurality of terminal locking portions each adapted to be elastically displaced, along with the insertion of each of the terminals into the terminal insertion portion, in an escape direction of escaping from the inserted terminal perpendicularly to the insertion direction, and to be displaced in a return direction, when the terminal reaches the normal fit position, to lock the terminal. The cap member is formed as a member separated from the connecting conductor and the housing to have a shape insertable into the cap-member insertion portion to be attached to the housing, so as to close the second opening of the cap-member insertion portion. The cap member has a cap portion with a shape capable of closing the cap-member insertion portion, and a fit detection portion protruding from the cap portion so as to direct to the terminal locking portions through between an outer wall of the housing and the joint portion of the connecting conductor held by the conductor holding portion of the housing. The fit detection portion has a shape to come into contact with the corresponding terminal locking portion, when any one of the terminals is located short of the normal fit position to thereby elastically displace the terminal locking portion corresponding to the terminal in the direction in which the terminal locking portion escapes from the terminal by a given distance or more, to prevent the cap member from being attached to the cap-member insertion portion.

In this joint connector, the connecting conductor including the fitting portions and the joint portion interconnecting the fitting portions is preliminarily held by the conductor holding portion of the housing, allowing the cap member to be inserted into the cap-member insertion portion of the housing after a fitting operation of the fitting portions with the respective terminals of the electric wires has been performed, which enables a resistance to the insertion of the cap member to be lowered, irrespective of the number of the terminals. This facilitates the fit detection of the terminals, thus ensuring the electrical interconnection of the terminals.

DESCRIPTION OF EMBODIMENTS

There will be described a preferred embodiment of the present invention with reference to the drawings.

Figure 1:
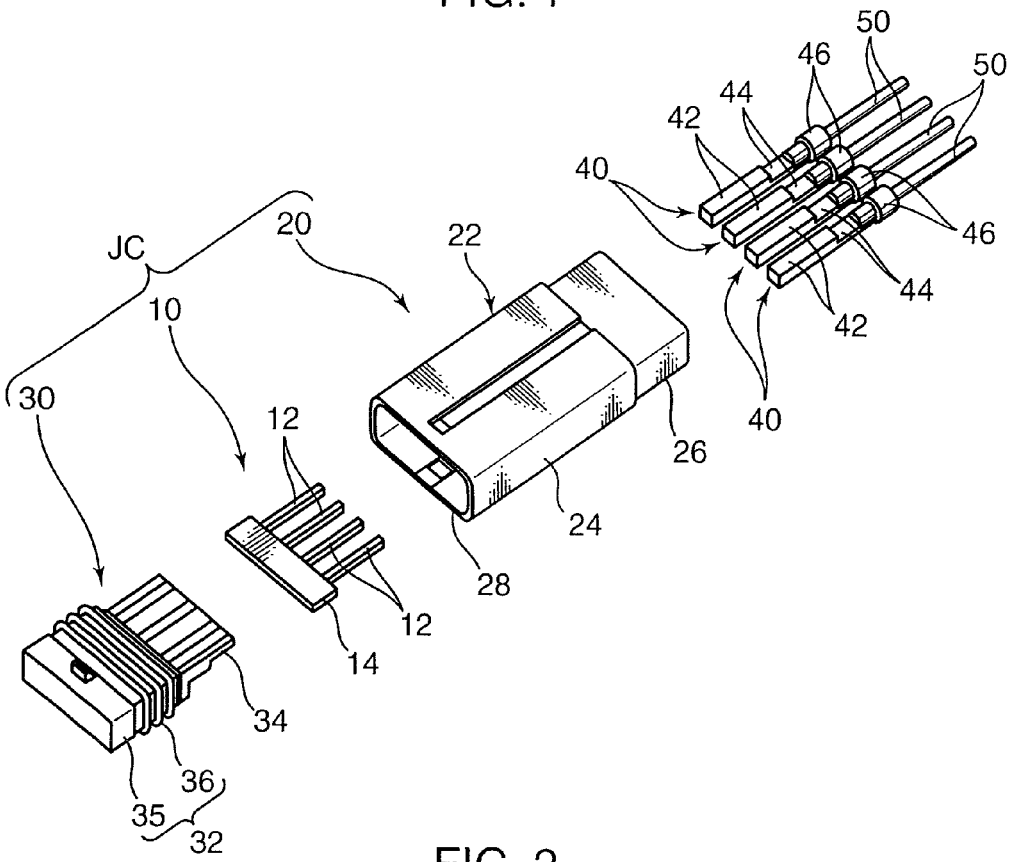
FIG. 1 is an exploded perspective view of a water-proofing joint connector according to one embodiment of the present invention.
Figure 2:
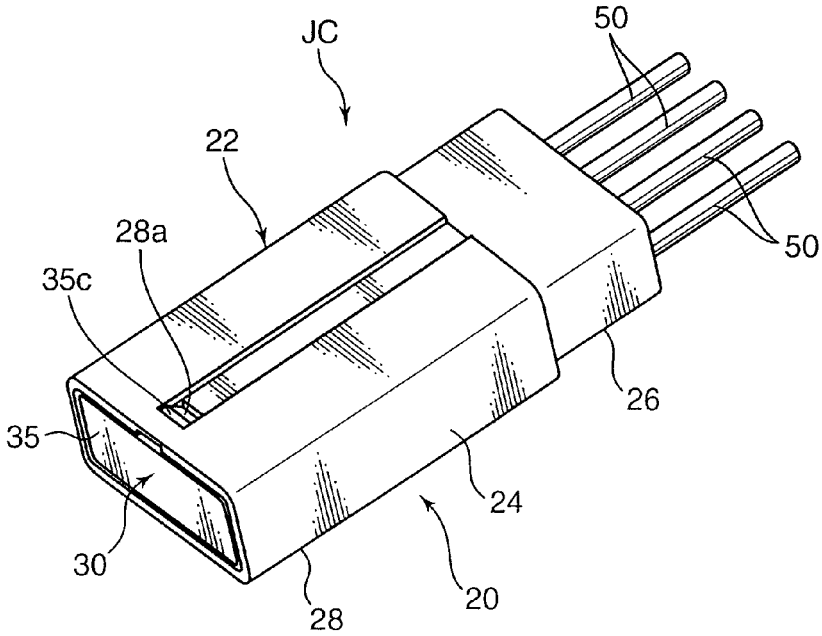
FIG. 2 is a perspective view showing a state where the water-proofing joint connector has interconnected a plurality of terminals.

FIG. 1 shows a plurality of electric wires (water-proofing electric wires) 50 and a water-proofing joint connector JC for interconnecting the electric wires 50. The electric wires 50 are included, for example, in a vehicle wire harness. Each of the electric wires 50A has an end, to which a terminal 40 is provided, the terminals 40 electrically being interconnected by use of the water-proofing joint connector JC.

Each of the electric wires 50 has a conductor and an insulation cover which covers the conductor. The insulation cover is partially removed in the end of the electric wire 50 to expose the conductor, to which the terminal 40 is connected. The terminal 40 integrally has a female-type eclectic contact section 42 and an electric-wire crimp section 44 formed on a rear side of the eclectic contact section 42. As with a commonly-known crimping terminal, the electric-wire crimp section 44 has a graphically expressed base plate and a pair of not graphically expressed barrels extending from respective ones of widthwisely opposite edges of the base plate, the barrels crimped onto the exposed conductor so as to enfold the exposed conductor. There is further provided a water-proofing plugs 46 at a position on a rear side of each of the terminal 40. Each of the water-proofing plug 46 is made of a soft material such as rubber, fixedly attached onto an outer peripheral surface of the insulation cover of the electric wire 50.

Figure 3:
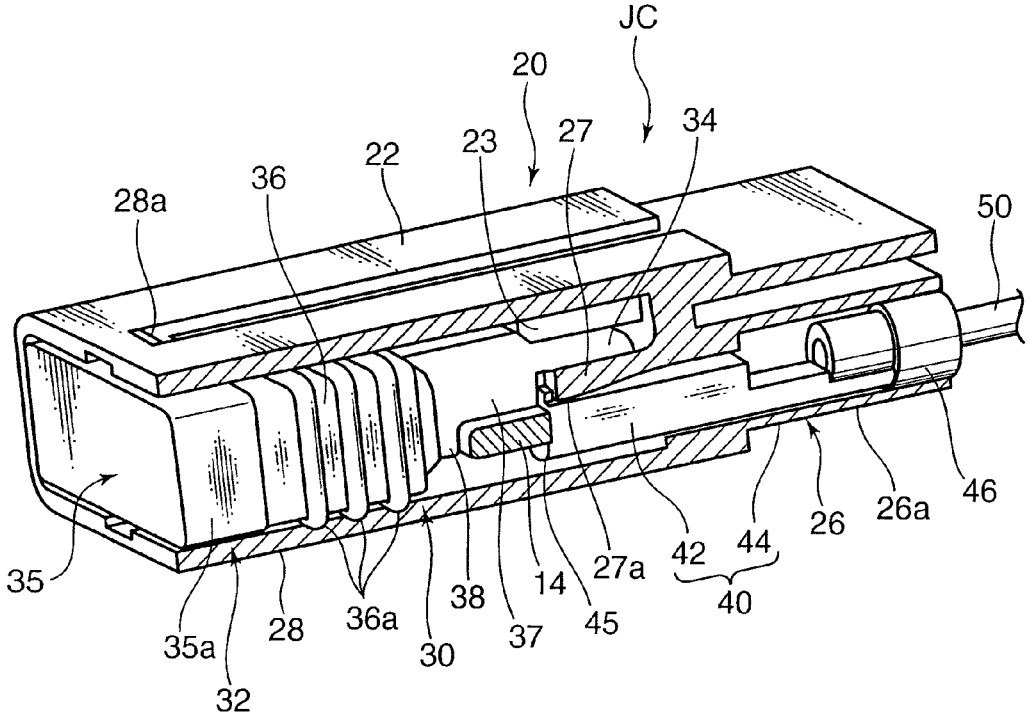
FIG. 3 is a perspective view including a vertical section showing an internal structure of the water-proofing joint connector.

As shown in FIGS. 1 and 3, the water-proofing joint connector JC comprises a connecting conductor 10 to be a medium for electrically interconnecting the terminals 40, a housing 20 for accommodating the connecting conductor 10, and a cap member 30 formed as a member separated from the connecting conductor 10 and the housing 20.

The connecting conductor 10 according to this embodiment is formed by punching a metal plate into a given shape, having a plurality of fitting portions 12 and a joint portion 14 interjoining the fitting portions 12. The fitting portions 12 are male-type electric contact sections, i.e., tabs, capable of fitting with the respective female-type electric contact sections 42 of the terminals 40 and arranged in a direction perpendicular to a fitting direction of the fitting (i.e., in an axial direction of each of the fitting portions 12). The joint portion 14 is shaped in a flat plate and integrally joined to respective rear ends (left ends in FIGS. 1 and 3) of the fitting portions.

The housing 20, the whole of which is integrally molded of an insulating material such as a synthetic resin, has a shape capable of accommodating the connection conductor 10. Specifically, the housing 20 includes an approximately tubular-shaped outer wall 22 having two openings at longitudinally opposite ends thereof, while having a pair of right and left conductor holding portions 24, a plurality of terminal insertion portions 26, a plurality of terminal locking portions 27, and a cap-member insertion portion 28.

The conductor holding portions 24 are formed on respective longitudinally intermediate regions of right and left inner surfaces of the outer wall 22. Each of the conductor holding portions 24 has a shape of directly holding corresponding one of longitudinally opposite ends (i.e., opposite ends in a direction parallel to the arrangement direction of the fitting portions 12) of the joint portion 14 of the connecting conductor 10 so as to clamp in a thickness direction thereof. Specifically, the ends of the joint portion 14 are press-fitted into respective ones of the conductor holding portions 24 so as to be clamped. In this state, between the joint portion 14 and the outer wall 22 of the housing 20, there is ensured a gap in a direction parallel to the thickness direction of the joint portion 14 (in FIGS. 1 and 3, an upward-downward direction).

Figure 4:
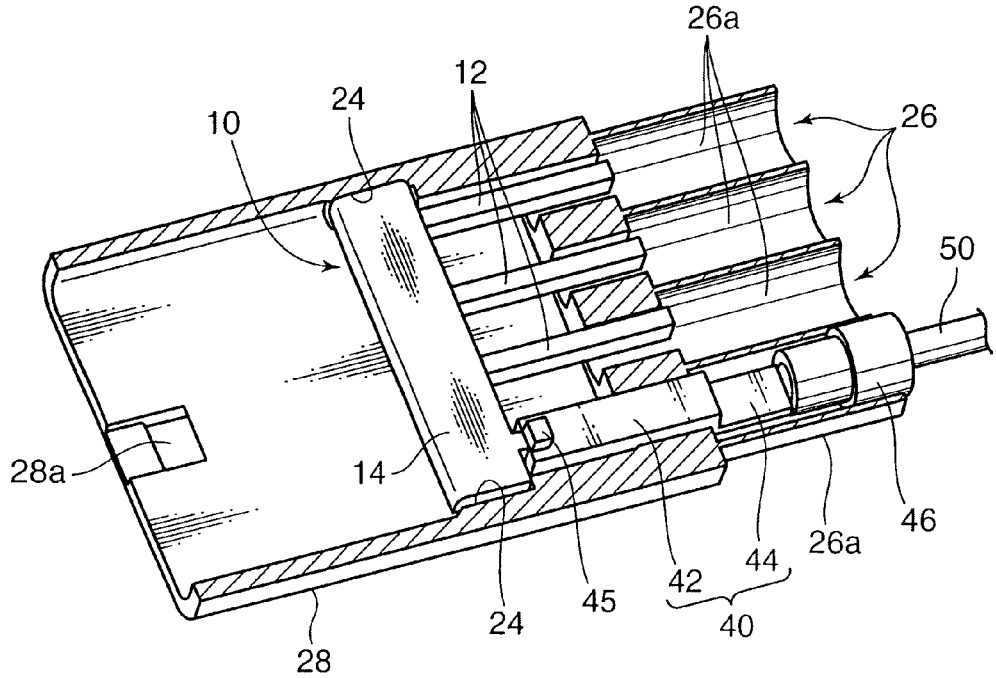
FIG. 4 is a perspective view including a horizontal section showing respective structures of a connection conductor and a housing of the water-proofing joint connector.
Figure 5:
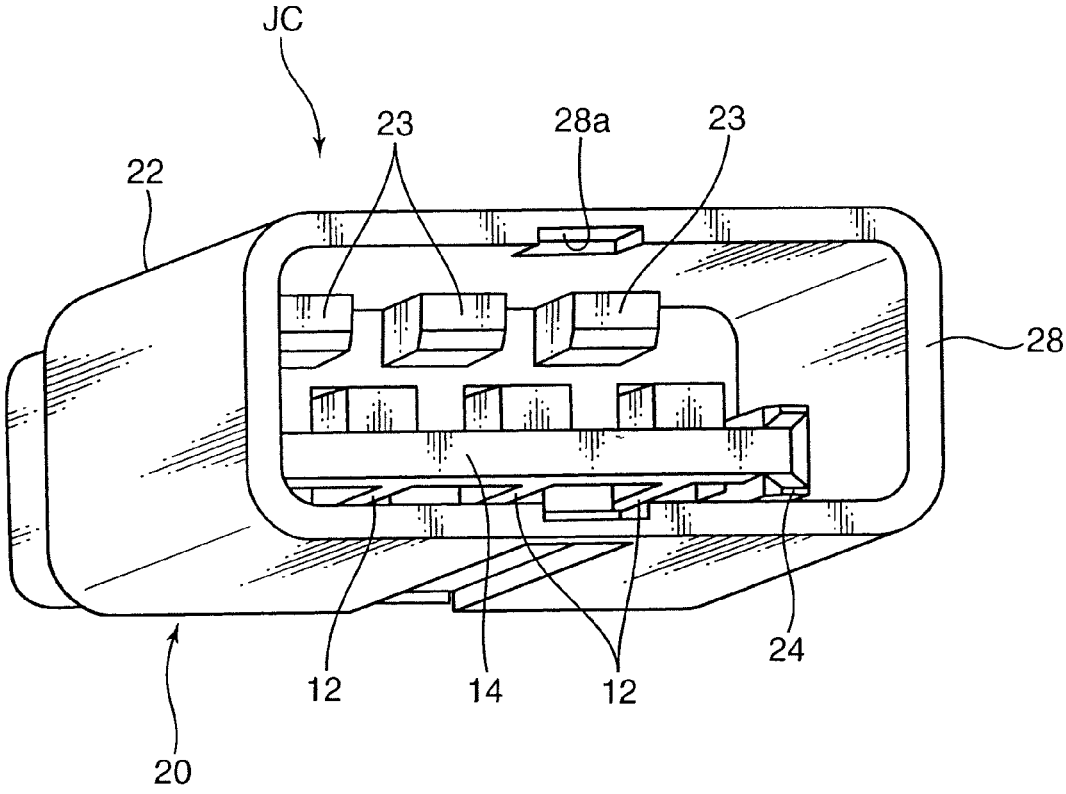
FIG. 5 is a perspective view showing an inside of the housing when viewed from the side of a cap-member insertion opening.

The terminal insertion portion 26 is formed for every terminal 40. Each of the terminal insertion portions 26 has an opening, namely, a first opening, which opens in one of the longitudinal directions of the housing 20 (in FIGS. 1, 3 and 4, a right direction), having a shape of allowing corresponding one of the terminals 40 to be inserted into the terminal insertion portion 26 through the opening. Each of the terminal insertion portions 26 has an inward-side half region to accommodate corresponding one of the fitting portions 12 of the connecting conductor 10 and an opening-side half region forming a cylindrical section 26*a* having a cylindrical inner peripheral surface. Each of the cylindrical sections 26*a* has a circular opening, through which the terminal 40 is inserted to be directly fitted into the fitting portion 12 at the inward-side. The cylindrical section 26*a* has an inner diameter which is set so as to allow the outer peripheral surface of the water-proofing plug 46 provided on the rear side of the inserted terminal 40 to come into tight contact with the inner peripheral surface of the cylindrical section 26*a* over an entire circumference thereof, in conjunction with the fitting-insertion of the terminal 40, involving elastic deformation of the water-proofing plug 46.

The terminal locking portion 27 is formed for every terminal insertion portion 26. Each of the terminal locking portions 27 is so-called a lance, shaped in a cantilever extending, from a part intermediate in the insertion direction of the terminal of the corresponding terminal insertion portion 26, toward the joint portion 14.

The terminal locking portion 27 has a free end which forms a locking portion 27*a* elastically displaceable (deflectable) in an upward-downward direction, i.e., a direction perpendicular to the insertion direction of the terminal 40. The locking portion 27*a* is adapted to be elastically displaced to escape from the terminal 40 being inserted, along the above direction (in FIGS. 1 and 3, the upward direction), and then be displaced in a return direction, when the terminal 40 has reached a normal fit position, so as to come into contact with a lockable protrusion 45 of the terminal 40 from the side of the terminal insertion opening to prevent the terminal 40 from being pull-out (to lock the terminal 40). The position of the locking portion 27*a* for the above lock may be a position when the terminal locking portion 27 is fully returned (i.e., a position when the terminal locking portion 27 is not deformed), or may be a position when the terminal locking portion 27 has a slightly remained elastic deformation.

The cap-member insertion portion 28 is constituted by a part of the outer wall 22 which part is located on an opposite side of the terminal insertion portions 26 across the conductor holding portions 24. Specifically, the cap-member insertion portion 28 has an approximately rectangular tubular shape having an opening, namely, a second opening, which opens in a direction opposite to the terminal insertion portions 26 and allowing the cap member 30 to be inserted into the housing 20 through the opening. The cap-member insertion portion 28 is provided with a pair of upper and lower locking holes 28*a* to lock the cap member 30 in the opening side end portion of the cap-member insertion portion 28.

The cap member 30, which is adapted to be inserted into the cap-member insertion portion 28 so as to close the opening of the cap-member insertion portion to be thereby attached to the housing 20, comprises a cap portion 32 and a fit detection portion 34. The cap portion 32 has a shape capable of closing the cap-member insertion portion, formed of a cap body 35 and a sealing member 36 made of an elastic material such as rubber.

Figure 7:
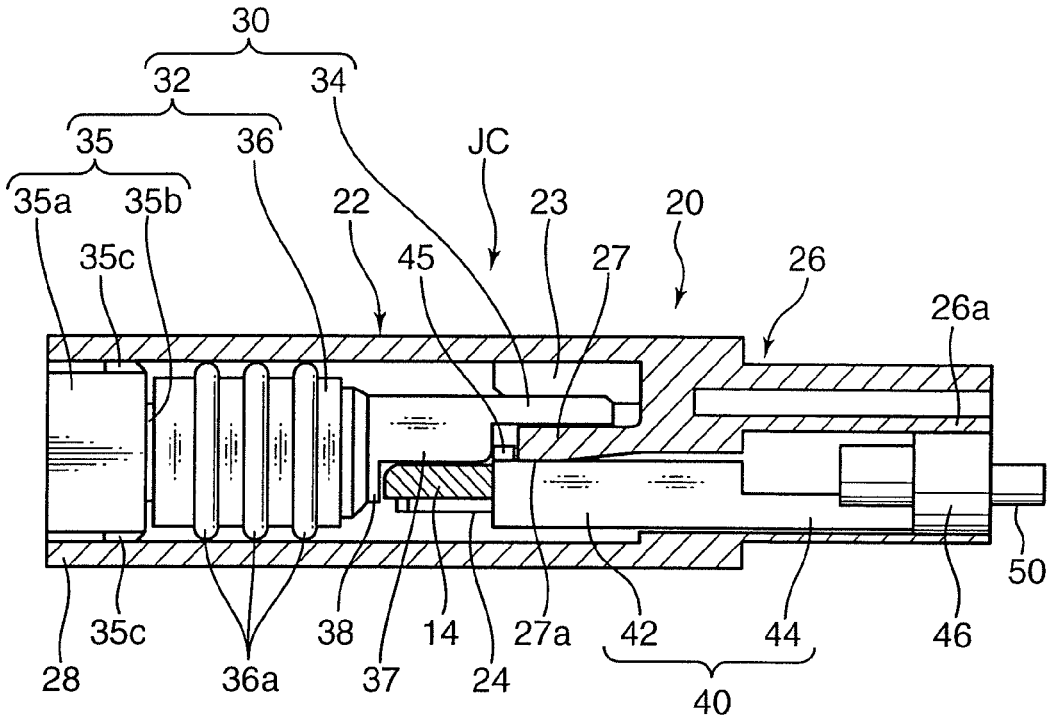
FIG. 7 is a sectional front view showing a state where the terminal has been inserted to a normal fit position in the housing.

The cap body 35 is integrally molded, together with the fit detection portion 34, of a resin harder than the sealing member 36, including an outer portion 35*a* with an outer peripheral surface slightly dimensionally smaller than an inner surface of the cap-member insertion portion 28 and a seat-member mounting portion 35*b* having an outer peripheral surface slightly dimensionally smaller than that of the outer portion 35*a* and positioned inward of the outer portion 35*a*; from the outer peripheral surface of the outer portion 35*a* are protruding a pair of lockable pawls 35*c*. Each of the lockable pawls 35*c* is formed at such a position as to be fitted into corresponding one of the locking holes 28*a* of the cap-member insertion portion 28 to be locked by the cap-member insertion portion 28 when the cap member 30 is fully inserted into the cap-member insertion portion 28 of the housing 20 as shown in FIGS. 3 and 7.

The sealing member 36 is fixed onto the outer peripheral surface of the seat-member mounting portion 35*b*. The sealing member 36 has an outer peripheral portion having a plurality of line-shaped protrusions 36*a* arranged in an insertion direction of the cap member 30. Each of the line-shaped protrusions 36*a* has a shape of continuing over an entire circumstance of the cap member 30 and protruding outwardly, adapted to come into press contact with an inner peripheral surface of the cap-member insertion portion 28 over an entire circumstance thereof, when the insertion of the cap member is being elastically deformed, to prevent external water from entering the housing 20.

The fit detection portion 34 according to this embodiment is shaped in a flat plate continuing in a width direction of the cap member 30 (the direction parallel to the arrangement direction of the fitting portions 12) and protruding from the cap body 35 toward an inward side of the housing 20. Specifically, the shape and position of the fit detection portion 34 are set to have the following functions.

1) Upon the insertion of the cap member 30 into the cap-member insertion portion 28, the fit detection portion 34, as shown FIGS. 3 and 6 to 8, reaches the terminal locking portions 27 so as to pass through between the outer wall 22 of the housing 20 and the joint portion 14 of the connecting conductor 10 held by the conductor holding portions 24 of the housing 20.

2) When the terminals 40 has been inserted to a normal fit position (a position where the electric contact section 42 of each of the terminals 40 and corresponding one of the fitting portions 12 of the connecting conductor 10 are fully fitted with each other) as shown in FIG. 7 to let the terminal locking portions 27 be elastically returned, the fit detection portion 34 enters between each the upper surface of the terminal locking portion 27 and a top wall of the housing 20 (an upper portion of the outer wall 22) to restrain the terminal locking portions 27 from upper side, that is, to restrict the terminal locking portions 27 from elastic displacement in a direction of escaping away from the terminals 40, i.e., in a direction of release of the lock.

Figure 8:
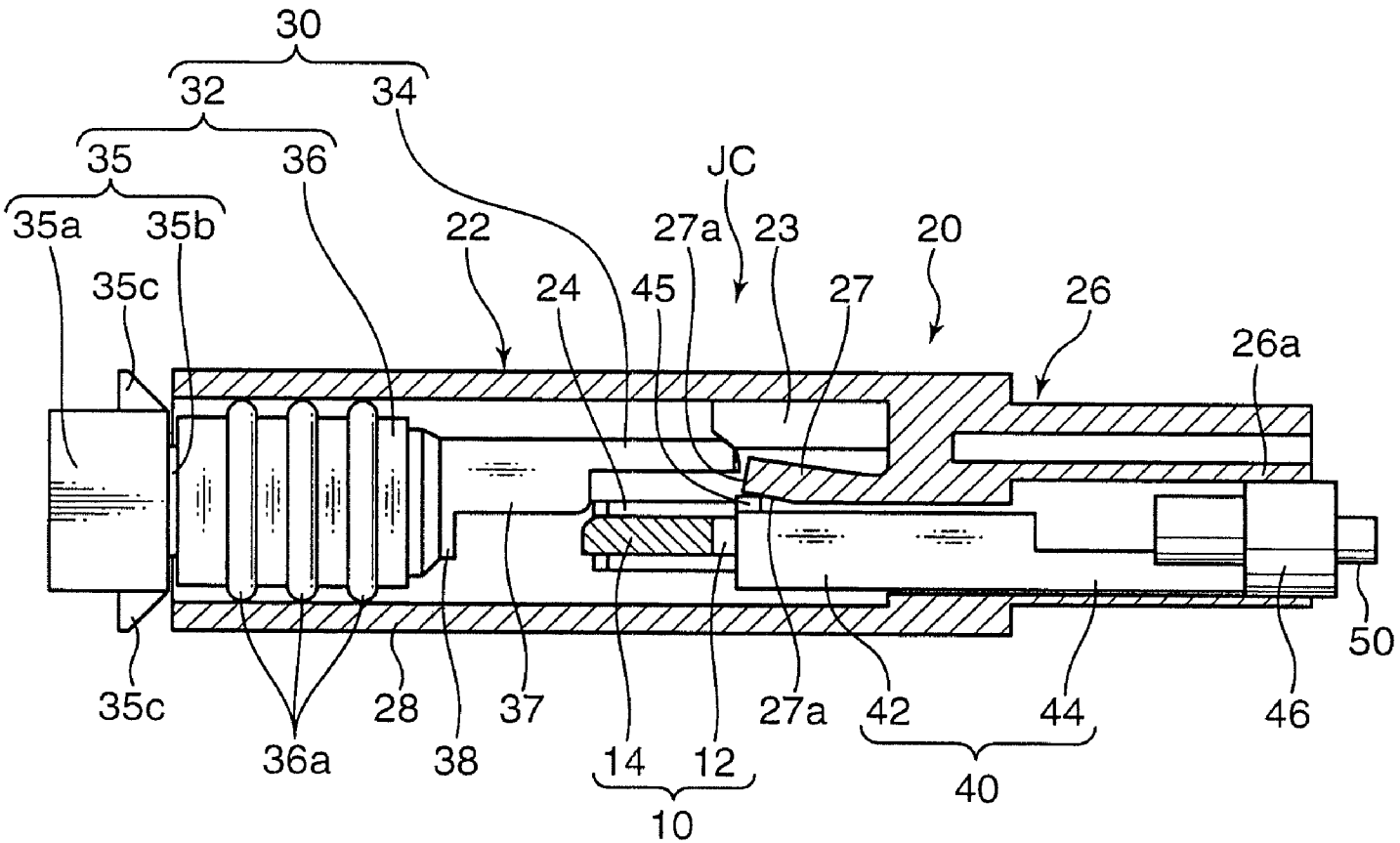
FIG. 8 is a sectional front view showing a state when the insertion of the terminal is being stopped short of the normal fit position in the housing.

3) When any one of the terminals 40 is not fully inserted to fail to reach the normal fit position (the position where the electric contact section 42 of the terminals 40 and corresponding one of the fitting portions 12 of the connecting conductor 10 is fully fitted with each other) as shown in FIG. 8, to thereby prevent corresponding one of the terminal locking portions 27 from elastic return, the fit detection portion 34 comes into contact with the corresponding terminal locking portion 27 in advance of the insertion of the cap member 30 to an attachment position (a position where the lockable pawls 35*c* are locked by the cap-member insertion portion 28), thus preventing the attachment of the cap member 30.

In this embodiment, the housing 20 has a top wall from which a fit-detection-portion guide portion 23 is provided to protrude downwardly, as shown in FIGS. 5 to 8. This fit-detection-portion guide portion 23 comes into contact with an upper surface of the fit detection portion 34 when the cap member 30 is being inserted, thereby stabilizing the height position thereof. On the other hand, the cap member 30 is formed with a guidable portion 37 bulging downwardly from a lower surface of the fit detection portion 34, the guidable portion 37 adapted to be guided by an upper surface of the joint portion of the connecting conductor 10 so as to make the fit detection portion 34 be inserted into between the top wall of the housing 20 and corresponding one of the terminal locking portion 27.

Furthermore, there is formed a conductor contact portion 38 under the guidable portion 37. The conductor contact portion 38 comes into contact with the joint portion 14 of the connecting conductor 10, when the cap member 30 is urged to be inserted beyond the normal attachment position, to thereby prevent an excessive insertion of the cap member 30.

Next will be described a process of electrically interconnecting the plurality of terminals 40 by use of the above water-proofing joint connector JC.

Firstly, into each of the terminal insertion portions 26 of the housing 20 of the water-proofing joint connector JC, the terminal corresponding to the terminal insertion portions 26 is inserted. Along the insertion direction, the electric contact section 42 of the terminal 40 is fitted into corresponding one of the fitting portion 12 of the connecting conductor 10 preliminarily held in the housing 20.

In the process of this insertion, the lockable protrusion 45 of each of the terminals comes into contact with the locking portion 27*a* of the corresponding one of the terminal locking portions 27 of the housing 20 to elastically displace the locking portion 27*a* upwardly (i.e., in the escape direction of escaping from the terminal 40). In other words, the locking portion 27*a* permits the insertion of the terminal 40 by its elastic displacement in the escape direction. The locking portion 27*a*, while being displaced in the return direction to lock the lockable protrusion 45 when the terminal 40 has been inserted to the normal fit position as shown in FIG. 7, cannot be displaced in the return direction when the terminal 40 has not been fully inserted to the normal fit position as shown in FIG. 8, thus being kept elastically displaced in the escape direction by a given distance or more.

Figure 6:
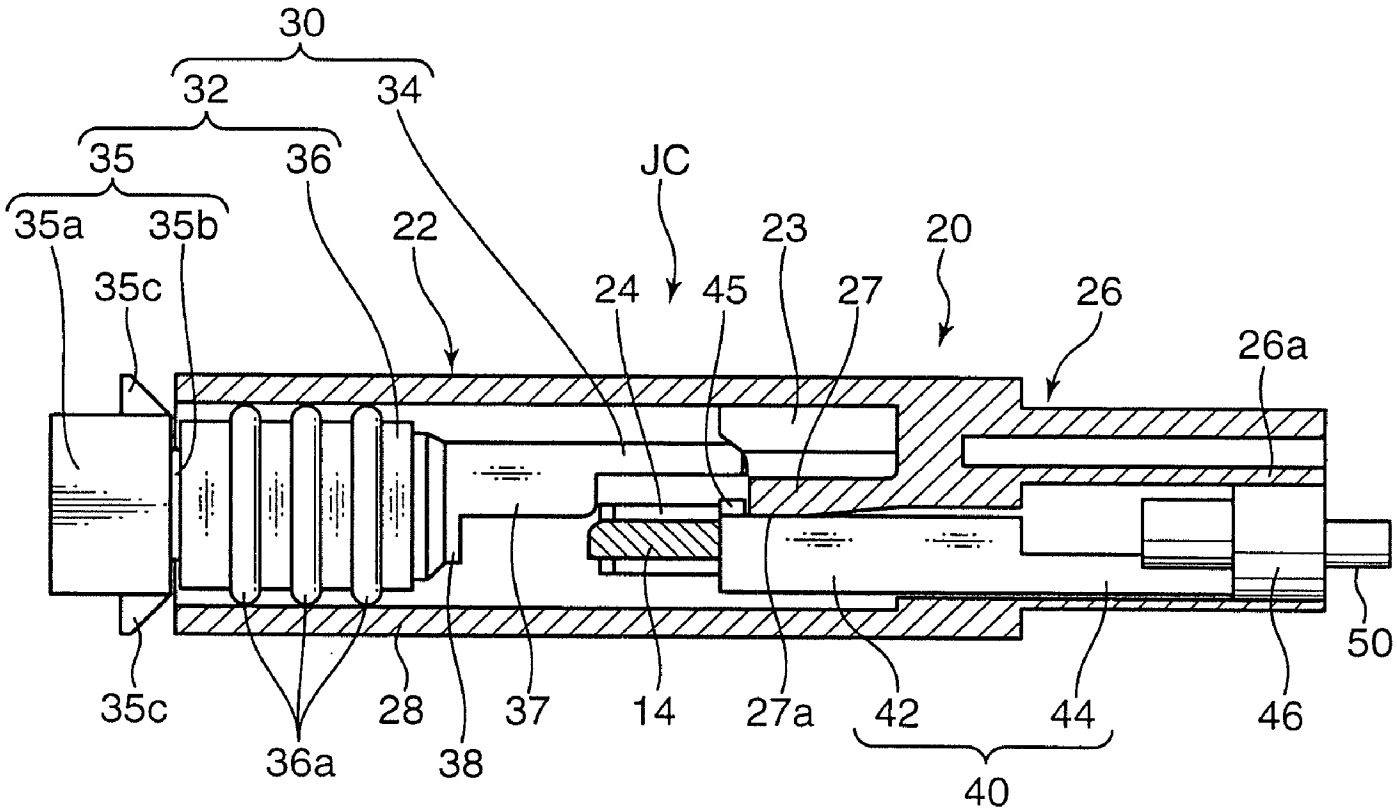
FIG. 6 is a sectional front view showing a state where a cap member is being inserted into a cap-insertion portion of the housing.

Following the above-mentioned operations of fitting all of the terminals 40 with the respective fitting portions 12, the cap member 30 is inserted into the cap-member insertion portion 28 of the housing 20, so as to let the fit detection portion 34 in advance, as shown in FIG. 6. The fit detection portion 34 is led to the terminal locking portions 27 passing between the joint portion 14 and the outer wall 22 of the housing 20 by the guide of the guidable portion 37 by the joint portion 14 of the connecting conductor 10 and the direct guide of the fit detection portion 34 of the cap member 30 by the fit-detection-portion guide portion 23.

In this operation, if all of the terminals 40 are fully inserted to the normal fit position illustrated in FIG. 7, the fit detection portion 34 can enter between the fit-detection-portion guide portion 23 and respective ones of the terminal locking portions 27. Thus, the cap member 30 is permitted to be inserted to the normal installation position where the lockable pawls 35*c* of the cap member 30 is fitted into the respective locking holes 28*a* of the cap-member insertion portion 28. In this attachment state, the fit detection portion 34 is located just above the terminal locking portions 27 to restrict elastic displacement of the terminal locking portions 27 in the upward direction, i.e., in the an unlock direction. This means that it fulfills a double locking function for the terminals 40.

Otherwise, if any one of the terminals 40 is not fully inserted to the normal fit position as shown in FIG. 8, the fit detection portion 34 comes into contact with the terminal locking portion 27 elastically displaced upwardly by the terminal 40 in the defectively inserted state, in the advance of the insertion of the cap member 30 to the attachment position, thereby preventing farther insertion (i.e., the attachment) of the cap member 30. This enables an operator to be recognized the insufficient insertion of any one of the terminals 40.

Figure 9:
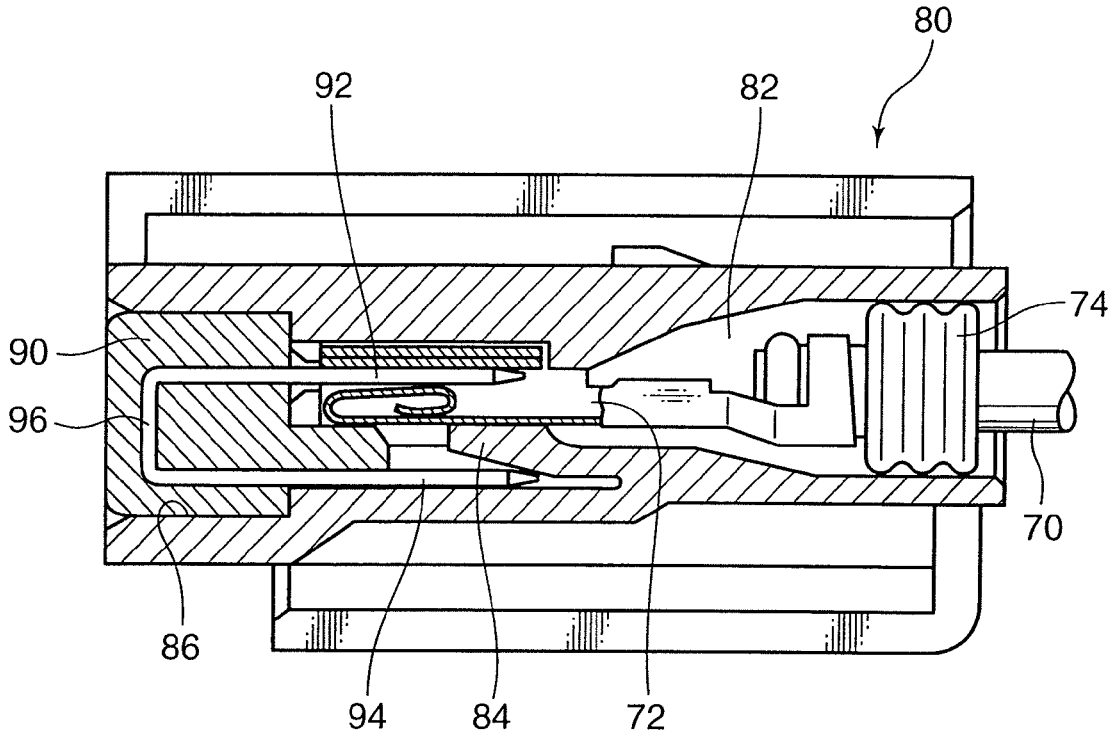
FIG. 9 is a sectional front view of a conventional water-proofing joint connector.

The water-proofing joint connector according to the embodiment is different from the aforementioned conventional connector shown in FIG. 9 in that: the connecting conductor 10 is not provided on the side of the cap member 30 but preliminarily held within the housing 20; and the cap member 30 is capable of being inserted into the cap-member insertion portion 28 following the finish of the fitting operation of the connecting conductor 10 with the terminals 40.

In the conventional connector shown in FIG. 9, where the insertion operation of the rubber plug body 90 and the fitting operation of the terminals 72 with the fitting portions 92 are simultaneously performed, the fitting resistances to all of the terminals 72 are added to the insertion resistance against the rubber plug body 90. Therefore, the greater the number of the terminals 72, the larger the insertion resistance become. This large insertion resistance is difficult to determine whether it is a resistance in a normal state or a resistance increased due to the contact of the insertion detection bar 94 with the deflectable support portion 84. Moreover, each of the deflectable support portions 84, which is required to hold corresponding one of the terminals 72 against the fitting resistance to the terminals 72 with the respective fitting portions 92, must have an increased size in order to ensure a sufficient locking force for the holding.

In contrast, in the above water-proofing joint connector JC, which involves that the connecting conductor 10 is so preliminarily held within the housing 20 as to allow the fitting operation for all of the terminals 40 to be finished in advance of the insertion operation for the cap member 30, the insertion resistance of the cap member 30 is permitted to be lower irrespective of the number of the terminals 40, and also the locking force required for each of the terminal locking portions 27 is permitted to be low. This enables an operator to easily determine the insertion resistance to the cap member 30 which resistance has been suddenly increased due to the contact of the fit detection portion 34 with the terminal locking portion 27 to be one caused by the defective insertion of the terminal 40. This results in a drastically easier detection of defective fitting than ever before.

The present invention is not limited to the aforementioned embodiment. For example, the fit detection portion 34 is not essentially required to have a double locking function for the terminals 40, but may be formed for each of the terminal locking portions 27.

A specific structure of the entire cap member 30 may be appropriately determined. For example, the guidable portion 37 and the conductor contact portion 38 can be omitted. Besides, the entire cap member 30 may be integrally formed of a single material. However, such a cap member having the cap portion 32 comprising the cap body 35 and the sealing member 36, the cap body 35 and the fit detection portion 34 integrally formed of a hard resin, as in the illustrated embodiment, makes it possible to reliably achieve tight contact between the sealing member 36 and the inner peripheral surface of the cap-member insertion portion 28 by utilization of the elastic deformation of the sealing member 36 mounted on the outer peripheral surface of the cap body 35 to ensure a high water-proofing function and to reliably provide to the fit detection portion 34 rigidity required for the terminal fit detection (i.e., characteristic of preventing deformation of the fit detection portion 34 itself due to the contact with the terminal locking portion 27), while the integral forming suppresses an increase in the number of components of the cap member 30.

Also a shape of the connecting conductor 10 is not limited to the graphically expressed one. The fitting portions 12 of the connecting conductor 10 may be arranged, for example, over a plurality of rows, as long as they are arranged in a direction perpendicular to the fitting direction of the terminals 40. Also the joint portion 14 is not essentially required to have a flat plate shape, but may have any other suitable shape allowing the fit detection portion 34 to pass through between the joint portion 14 and the outer wall of the housing 22.

As above, the present invention provides a water-proofing joint connector capable of electrically interconnecting a plurality of terminals, with a simple structure, irrespective of the number of water-proofing electric wires or the terminals. This water-proofing joint connector is designed to electrically interconnect a plurality of water-proofing electric wires each including an end provided with a terminal and a water-proofing plug provided on a rear side of the terminal, comprising a connection conductor, a housing and a cap member. The connecting conductor integrally has a plurality of fitting portions each formed in a shape fittable with corresponding one of the terminals, the fitting portions arranged in a direction perpendicular to a fitting direction in which the fitting portion is fitted with the terminal, and a joint portion interjoining the fitting portions. The housing includes: a plurality of terminal insertion portions each having a first opening which opens in a specific direction to allow corresponding one of the terminals and the water-proofing plug on the rear side thereof to be inserted into the terminal insertion portion through the first opening, each the terminal insertion portions having an inner peripheral surface with a shape tightly contactable with the water-proofing plug; a cap-member insertion portion having a second opening which opens in a direction opposite to the terminal insertion portions; a conductor holding portion directly holding the connecting conductor so as to allow the terminals inserted through the respective first openings of the terminal insertion portions to a normal fit position to be fitted with respective one of the fitting portions along an insertion direction in which the terminal is inserted; and a plurality of terminal locking portions each adapted to be elastically displaced, along with the insertion of corresponding one of the terminals into corresponding one of the terminal insertion portions, in an escape direction of escaping from the terminal along a direction perpendicular to the insertion direction and to be displaced in a return direction, when the terminal has reached the normal fit position, to lock the terminal. The cap member is formed as a member separated from the connecting conductor and the housing to have a shape insertable into the cap-member insertion portion to be attached to the housing, so as to close the second opening of the cap-member insertion portion. The cap member has a cap portion with a shape capable of closing the cap-member insertion portion, and a fit detection portion protruding from the cap portion so as to direct to the terminal locking portions through between an outer wall of the housing and the joint portion of the connecting conductor held by the conductor holding portion of the housing. The fit detection portion has a shape to come into contact with the corresponding terminal locking portion, when any one of the terminals is located short of the normal fit position to thereby elastically displace the terminal locking portion corresponding to the terminal in the direction in which the terminal locking portion escapes from the terminal by a given distance or more, to prevent the cap member from being attached to the cap-member insertion portion.

In this joint connector, the connecting conductor including the fitting portions and the joint portion interjoining the fitting portions is preliminarily held by the conductor holding portion of the housing, thus allowing the cap member to be inserted into the cap-member insertion portion of the housing following the operation of fitting the fitting portions with the respective terminals of the electric wires are performed, so that an insertion resistance to the cap member can be lowered, irrespective of the number of the terminals. This facilitates the fit detection of the terminals to ensure the electrical interconnection of the terminals.

Specifically, each of the terminals can be fitted with the fitting portion corresponding to the terminal by the insertion thereof into corresponding one of the terminal insertion portions in the housing. In this operation, the terminal locking portion of the housing is elastically displaced in the escape direction of escaping from the terminal to thereby permit the insertion of the terminal, and then displaced in the return direction, when the terminal is inserted to the normal fit position, to lock the terminal. If the terminal is not fully inserted to the normal fit position, the terminal locking portion is not permitted to be displaced in the return direction, thus being kept elastically displaced by a given distance or more.

Following that all of the terminals are thus fitted with the respective fitting portions, the cap member is inserted into the cap-member insertion portion of the housing. The fit detection portion of the inserted cap member reaches a region of the terminal locking portions through between the joint portion of the connecting conductor and the outer wall of the housing and then; however, if any one of the terminals fails to be fully inserted to the normal fit position, the fit detection portion comes into contact with the terminal locking portion corresponding to the terminal (i.e., the terminal locking portion failing to be displaced in the return direction) to thereby prevent the attachment of the cap member to the cap-member insertion portion. This prevention of the attachment can let an operator know the presence of the insufficiently inserted terminal.

In addition, the fitting resistance to the terminals and the fitting portions of the connecting conductor is never added to an insertion resistance to the cap member, differently from the conventional connector involving an integral insertion of the cap member and the connecting conductor into the housing, because the cap member and the connecting conductor are separate components and the cap member is inserted after the fitting operation of the terminals with the respective fitting portions of the connecting conductor preliminary held within the housing. This enables an operator to easily determine an increase in the insertion resistance of the cap member due to the contact between the fit detection portion and the terminal locking portion. In short, the defective fitting can be easily detected.

The fit detection portion of the cap member preferably has a shape of entering between the outer wall of the housing and each of the terminal locking portions to restrain the terminal locking portions in the state where the terminals reach to the normal fit position to be thereby locked by the terminal locking portions. The thus shaped fit detection portion can fulfill not only the fit detection function but also a double locking function of preventing the terminal locking portions from being displaced in an unlock direction to more ensure the lock of the terminals.

The cap member preferably includes a guidable portion to be guided by the joint portion of the connecting conductor so as to lead the fit detection portion between the outer wall of the housing and the respective ones of the terminal locking portions. The guidable portion can lead the fit detection portion to a position suitable for the fit detection, by effective utilize of the presence of the joint portion of the connecting conductor in the housing.

The cap member preferably includes a conductor contact portion to come into contact with the joint portion of the connecting conductor to prevent an excessive insertion of the cap member into the cap-member insertion portion. This conductor contact portion can reliably prevent an excessive insertion of the cap member, by utilization of the presence of the joint portion of the connecting conductor in the housing.

A specific structure of the cap member may be appropriately designed. For example, in the case of the cap portion of the cap member having a cap body and a sealing member mounted on an outer peripheral surface of the cap body to come into tight contact with an inner peripheral surface of the cap-member insertion portion over an entire circumference thereof in an elastically deformed state, the cap body and the fit detection portions being made of a resin harder than the sealing member, the tight contact between the sealing member and the inner peripheral surface of the cap-member insertion portion can be ensured by utilization of an elastic deformation of the sealing member mounted on the outer peripheral surface of the cap body to ensure a high water-proofing function, while the fit detection portion is reliably given rigidity required for the terminal fit detection. Furthermore, in the case of the cap body and the fit detection portion which are integrally formed together of a resin harder than the sealing member, the integral forming allows the number of components of the cap member to be decreased.

What is claimed is:

1. A water-proofing joint connector for electrically interconnecting a plurality of water-proofing electric wires each including an end provided with a terminal and a water-proofing plug provided on a rear side of the terminal, comprising:

a connecting conductor which integrally has a plurality of fitting portions each formed in a shape fittable with corresponding one of the terminals, the fitting portions arranged in a direction perpendicular to a fitting direction thereof, and a joint portion interjoining the fitting portions;

a housing which includes a plurality of terminal insertion portions each having a first opening which opens in a specific direction to allow corresponding one of the terminals and the water-proofing plug on the rear side of the terminal to be inserted into the terminal insertion portion through the first opening and an inner peripheral surface with a shape tightly contactable with the water-proofing plug, a cap-member insertion portion having a second opening which opens in a direction opposite to the terminal insertion portions, a conductor holding portion directly holding the connecting conductor so as to allow each of the terminals inserted through the first opening of the terminal insertion portion to a normal fit position to be fitted with corresponding one of the fitting portions along an insertion direction of the terminal, and a plurality of terminal locking portions each adapted to be elastically displaced, along with the insertion of corresponding one of the terminals into corresponding one of the terminal insertion portions, in an escape direction of escaping from the terminal along a direction perpendicular to the insertion direction, and to be displaced in a return direction, when the terminal reaches the normal fit position, to lock the terminal; and a cap member formed as a member separated from the connecting conductor and the housing to have a shape insertable into the cap-member insertion portion to be attached to the housing, so as to close the second opening of the cap-member insertion portion, the cap member having a cap portion with a shape capable of closing the cap-member insertion portion, and a fit detection portion protruding from the cap portion so as to direct to the terminal locking portions through between an outer wall of the housing and the joint portion of the connecting conductor held by the conductor holding portion of the housing, the fit detection portion having a shape to come into contact with the corresponding terminal locking portion, when any one of the terminals is located short of the normal fit position to thereby elastically displace the terminal locking portion corresponding to the terminal in the escape direction in which the terminal locking portion escapes from the terminal by a given distance or more, to prevent the cap member from being attached to the cap-member insertion portion.

2. The water-proofing joint connector as defined in claim 1, wherein the cap portion of the cap member has a cap body and a sealing member mounted on an outer peripheral surface of the cap body to come into tight contact with an inner peripheral surface of the cap-member insertion portion over an entire circumference thereof while elastically deformed, each of the cap body and the fit detection portion being made of a resin harder than the sealing member.

3. The water-proofing joint connector as defined in claim 1, wherein the fit detection portion of the cap member has a shape capable of entering between the outer wall of the housing and respective ones of the terminal locking portions in the state where the terminals reach to the normal fit position to be locked by the terminal locking portions, to thereby restrain the terminal locking portions.

4. The water-proofing joint connector as defined in claim 3, wherein the cap member includes a guidable portion to be guided by the joint portion of the connecting conductor to lead the fit detection portion between the outer wall of the housing and the respective terminal locking portions.

5. The water-proofing joint connector as defined in claim 3, wherein the cap member includes a conductor contact portion to come into contact with the joint portion of the connecting conductor to thereby prevent an excessive insertion of the cap member into the cap-member insertion portion.

* * * * *